US008054142B2

(12) United States Patent
Fujita

(10) Patent No.: US 8,054,142 B2
(45) Date of Patent: Nov. 8, 2011

(54) PLURAL RECTANGULAR WAVEGUIDES HAVING LONGER CROSS-SECTIONAL LENGTHS BASED ON SHORTER WAVEGUIDE LINE LENGTHS

(75) Inventor: Akihisa Fujita, Anjo (JP)

(73) Assignee: Denso Corporation, Kariya (JP)

( * ) Notice: Subject to any disclaimer, the term of this patent is extended or adjusted under 35 U.S.C. 154(b) by 152 days.

(21) Appl. No.: 12/381,009

(22) Filed: Mar. 6, 2009

(65) Prior Publication Data

US 2009/0224858 A1 Sep. 10, 2009

(30) Foreign Application Priority Data

Mar. 6, 2008 (JP) ..... 2008-056396

(51) Int. Cl.
*H01P 3/12* (2006.01)

(52) U.S. Cl. ..... 333/1; 333/34; 333/137; 333/239

(58) Field of Classification Search ..... 333/239, 333/248, 137, 26, 1, 34
See application file for complete search history.

(56) References Cited

U.S. PATENT DOCUMENTS

| | | | | |
|---|---|---|---|---|
| 3,150,336 | A * | 9/1964 | Gonda | 333/33 |
| 3,292,115 | A * | 12/1966 | La Rosa | 333/208 |
| 4,588,962 | A | 5/1986 | Saito et al. | |
| 6,239,669 | B1 | 5/2001 | Koriyama et al. | |

FOREIGN PATENT DOCUMENTS

| | | |
|---|---|---|
| JP | 59-004205 | 1/1984 |
| JP | 10-303615 | 11/1998 |
| JP | 2001-136008 | 5/2001 |
| JP | 2004-221718 | 8/2004 |
| JP | 2007-266866 | 10/2007 |

OTHER PUBLICATIONS

Office Action dated Jan. 26, 2010 in Japanese Application No. 2008-056396 with English translation thereof.

* cited by examiner

*Primary Examiner* — Benny Lee
(74) *Attorney, Agent, or Firm* — Harness, Dickey & Pierce, PLC

(57) ABSTRACT

Long-side length a1 to a5 of rectangular waveguide tubes in a long-side direction (magnetic field direction) become greater, the shorter a line length is (the closer a rectangular waveguide tube is to the center). ai and Li are set such that line lengths L1 to L5 of each rectangular waveguide tube is Li=mλgi (i=1 to 5, and m is a positive integer number), with guide wavelengths of each rectangular waveguide tube, determined by the length a1 to a5, as λg1 to λg5. Hence, the line length Li of each rectangular waveguide tube can be arbitrarily set, while maintaining a phase relationship between high frequency signals transmitted by each rectangular waveguide tube. When a difference in line lengths between rectangular waveguide tubes is set to be shorter, the degree of freedom in arrangement of the rectangular waveguide tubes can be improved while suppressing the degradation of propagation characteristics caused by temperature change.

14 Claims, 7 Drawing Sheets

PASSAGE LOSS AT P1 TO P2 ( dB )

PLURAL RECTANGULAR WAVEGUIDES HAVING LONGER CROSS-SECTIONAL LENGTHS BASED ON SHORTER WAVEGUIDE LINE LENGTHS

CROSS-REFERENCE TO RELATED APPLICATION

This application is related to Japanese Patent Application NO. 2008-56396 filed on Mar. 6, 2008, the contents of which are hereby incorporated by reference.

BACKGROUND OF THE INVENTION

1. Field of the Invention

The present invention relates to a high frequency device including a plurality of rectangular waveguide tubes.

2. Description of the Related Art

Conventionally, a high frequency device has been known which transmits high frequency signals using rectangular waveguide tubes. For example, in Japanese Patent Laid-open Publication No. 2004-221718, a high frequency device that performs transmission of high frequency signals is disclosed in which two metal plates are joined and a plurality of rectangular waveguide tubes are formed on the joint surface. In this type of high frequency device, when a phase relationship is required to be maintained between the high frequency signals to be transmitted, the rectangular waveguide tubes are arranged such that line lengths of the rectangular waveguide tubes are equal or the line lengths differ only by an integral multiple of a guide wavelength.

However, in either case, because the line lengths are designed in a fixed manner, the rectangular waveguide tubes cannot be freely designed. Moreover, transmission loss is unnecessarily increased particularly when lines are arranged such that the line lengths are equal, because the line lengths are set to the longest line length.

On the other hand, when the lines are arranged such that the line lengths differ only by an integral multiple of the guide wavelength, variations in loss increase between channels, and degradation of propagation characteristics increases because the line lengths differ due to temperature change.

In other words, when the line lengths of two rectangular waveguide tubes differ, the rectangular waveguide tube with the longer line length is more affected by temperature change. As a result, the phase relationship between high frequency signals differs at an input terminal and an output terminal of the rectangular waveguide tube, thereby degrading the propagation characteristics.

SUMMARY OF THE INVENTION

The present invention has been developed to solve the above-described issues. An object of the present invention is to provide a high frequency device that allows a high degree of freedom in arrangement of rectangular waveguide tubes, and can suppress degradation of propagation characteristics caused by temperature change.

To achieve the above-described object, a high frequency device comprises a plurality of rectangular waveguide tubes that transmit high frequency signals and have different line lengths in a longitudinal direction thereof, in which the high frequency signals are transmitted such that a phase relationship between the high frequency signals at input terminals of the plurality of rectangular waveguide tubes is maintained even at output terminals of the plurality of rectangular waveguide tubes, the high frequency device, wherein, the rectangular waveguide tube has a rectangular section cut perpendicularly to the longitudinal direction of the waveguide tube, the rectangular section consisting of long-side edges and short side edges, each of these lengths being defined as a long-side length and a short-side length, the long-side length set to be longer as the line lengths become shorter so as to allow a guide wavelength in the waveguide tube becomes shorter.

When a free space wavelength of a high frequency signal to be transmitted is $\lambda$ and a length of the rectangular waveguide tube in a long-side direction (i.e., magnetic field direction) is a (where, $a>\lambda/2$), a guide wavelength $\lambda g$ is expressed by Expression 1.

[Expression 1]

$$\lambda_g = \frac{\lambda}{\sqrt{1-\left(\frac{\lambda}{2a}\right)^2}} \tag{1}$$

In other words, the guide wavelength $\lambda g$ increases, the smaller a tube width a is (i.e., a term ($\lambda/2a$) approaching ($\lambda/2$)). The guide wavelength $\lambda g$ decreases (becomes closer to $\lambda$), the larger the tube width a is.

DETAILED DESCRIPTION OF THE PREFERRED EMBODIMENTS

Embodiments of the present invention will hereinafter be described with reference to the drawings, where like features in different drawing figures are denoted by the same reference label, which may not be described in detail for every drawing in which they appear.

First Embodiment

Figure 1B:
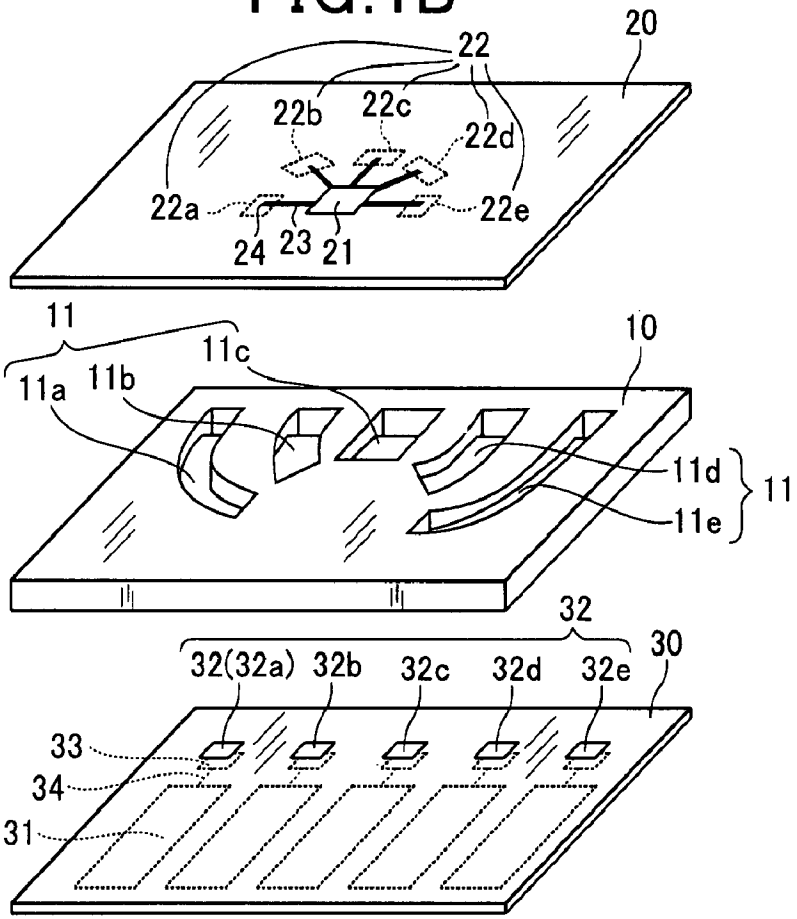
FIG. 1A and FIG. 1B are perspective views each showing an overall structure of a high frequency device according to a first embodiment of the present invention.
Figure 1A:
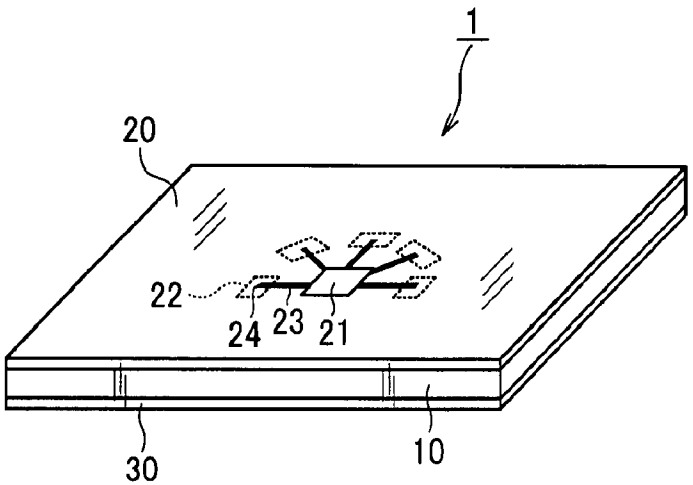

FIG. 1A is a perspective view of an overall configuration of a high frequency device 1 to which the present invention is applied. FIG. 1B is an exploded perspective view of the high frequency device 1 (FIG. 1A).

The high frequency device 1 is applied to a radar device using millimeter waves and microwaves, and the like.

As shown in FIG. 1A and FIG. 1B, the high frequency device 1 includes a waveguide tube plate 10, a first substrate 20, and a second substrate 30. A plurality (five according to the first embodiment) of rectangular waveguide tubes 11 (11*a*, 11*b*, 11*c*, 11*d* and 11*e* in FIG. 1B) are formed on the waveguide tube plate 10, which is made of a metallic plate (conductor). The first substrate 20 and the second substrate 30 are integrally attached to both sides of the waveguide tube plate 10 by screws and the like. Each of the rectangular waveguide tubes (11*a*, 11*b*, 11*c*, 11*d* and 11*e* in FIG. 1B) has a waveguide passage having a rectangular section cut perpendicularly to the longitudinal direction of the waveguide tube. This rectangular section cut has a short-side edge in a short-side direction and long-side edge, the length of the long side edge, i.e., passage length in the long-side direction, which will now be referred to as "long-side length", is set to "a". Also, it is referred to "short-side length" for the passage length in the short side-direction.

As shown in FIG. 1B, the first substrate 20 is a resin-made substrate. High frequency circuits are formed (printed) on a surface (non-joint surface) of the first substrate 20 opposite to the joint surface with the waveguide tube plate 10. The high frequency circuits are, for example, an oscillator 21 that generates high frequency signals, high frequency line 23 formed by strip lines that transmit an output from the oscillator 21 to rectangular areas 22 serving as an input terminal of each rectangular waveguide tube 11, and transitions 24 that convert electrical signals (the output from the oscillator 21) provided via the high frequency line 23 into electromagnetic waves and emit the electromagnetic waves towards the rectangular waveguide tubes 11.

At the same time, as shown in FIG. 1B, the second substrate 30 is a resin-made substrate, like the first substrate 20. Antenna sections 31, transitions 33, high frequency line 34, and the like are formed (printed) on a surface of the second substrate 30 opposite to the joint surface with the waveguide tube plate 10, such as to correspond to each of the rectangular waveguide tubes 11. The antenna sections 31 are formed by a plurality of patch antennas being arrayed in a single row. The transitions 33 convert the high frequency signals provided via the rectangular waveguide tubes 11 into electrical signals at rectangular areas 32 (32*a*, 32*b*, 32*c*, 32*d* and 32*e* in FIG. 1B) serving as output terminals of the rectangular waveguide tubes 11. The high frequency lines 34 are formed by strip lines that transmit the electrical signals converted by the transitions 33 to the antenna sections 31.

On the joint surfaces of both the first substrate 20 and the second substrate 30 with the waveguide tube plate 10, grounding patterns 25 and 35 (see FIG. 3) are formed (printed) on the overall surfaces, excluding the rectangular areas 22 and 32 in FIG. 1B, serving as the input terminals or the output terminals of the rectangular waveguide tubes 11.

However, in the rectangular areas 22 (22*a*, 22*b*, 22*c*, 22*d* and 22*e* in FIG. 1B) of the first substrate 20, the high frequency line 23 that reach from the oscillator 21 provided in the center of the first substrate 20 to each rectangular area 22 are provided in a radiating manner such that all high frequency line 23 have a same length. On the other hand, the rectangular areas 32 (32*a*, 32*b*, 32*c*, 32*d* and 32*e* in FIG. 1B) of the second substrate 30 in FIG. 1B, are arrayed in a row along one side of the second substrate 30.

Figure 2A:
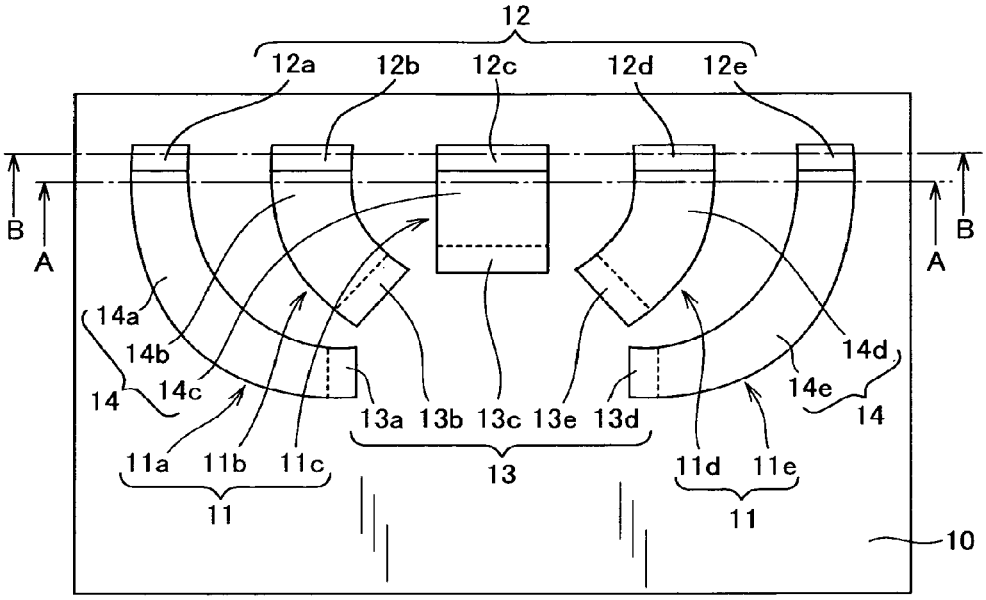
FIG. 2A, FIG. 2B, and FIG. 2C are a planar view and cross-sectional views showing a waveguide tube plate according to the first embodiment.
Figure 2B:
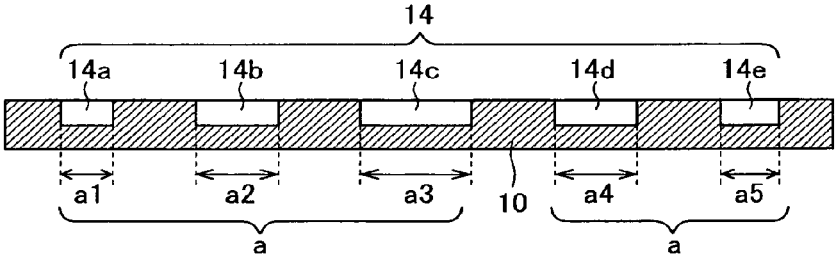
Figure 2C:
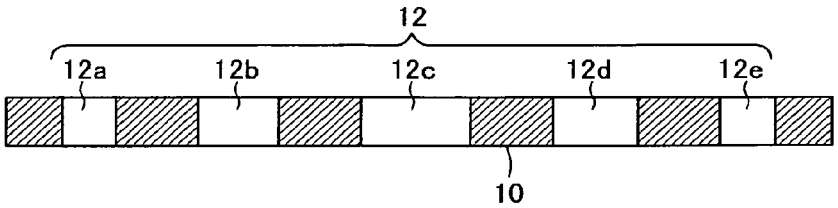
Figure 3:
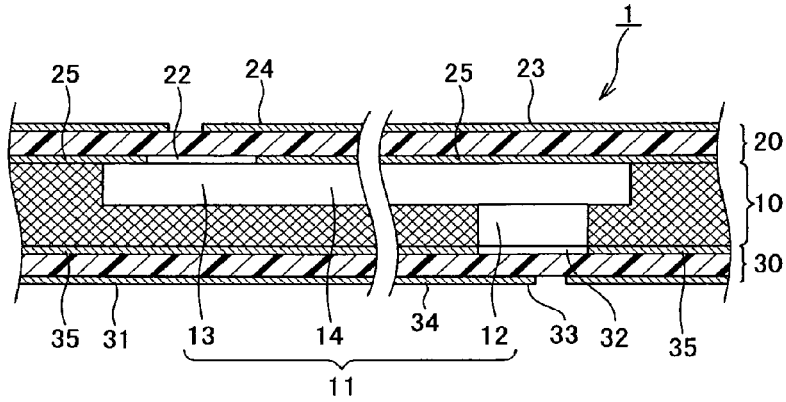
FIG. 3 is a cross-sectional view showing the vicinity of input and output terminals of a rectangular waveguide tube in the high frequency device.

Here, FIG. 2A is a planar view of the waveguide tube plate 10, viewed from the side of the joint surface with the first substrate 20. FIG. 2B is a cross-sectional view taken along A-A. FIG. 2C is a cross-sectional view taken along B-B. FIG. 3 is an explanatory diagram of a cross-sectional shape of input and output terminal sections of the rectangular waveguide tube 11.

As shown in FIGS. 2A and 2C, through holes 12 (12*a*, 12*b*, 12*c*, 12*d* and 12*e* in FIGS. 2A, 2B) are formed on the waveguide tube plate 10 at positions opposing the rectangular areas 32 (32*a*, 32*b*, 32*c*, 32*d* and 32*e*) of the second substrate 30 in FIG. 1B. The through holes 12 each pass through the waveguide tube plate 10 in the plate thickness direction.

On the joint surface of the waveguide tube plate 10 with the first substrate 20, grooves 14 (14*a*, 14*b*, 14*c*, 14*d* and 14*e* in FIGS. 2A, 2B) are respectively formed such as to extend from each through hole 12 (12*a* to 12*e*) to an opposing area 13 (13*a*, 13*b*, 13*c*, 13*d* and 13*e* in FIG. 2A) that opposes each rectangular area 22 (22*a* to 22*e*) of the first substrate 20 in FIG. 1B.

In other words, as shown in FIG. 3, the rectangular waveguide tube 11 is formed by the through hole 12, the groove 14, the opposing area 13, and the grounding pattern 25 on the first substrate 20 that covers the groove 14. In both end sections of the rectangular waveguide tube 11, E-bends serving as the input and output terminals are formed by the rectangular areas 22 and 32.

Therefore, the grooves 14 have depths equal to a length of the short-side edge of the rectangular waveguide tubes 11, and widths equal to a long-side length of the rectangular waveguide tubes 11. As shown in FIG. 2B, the groove 14 positioned at the center (14*c*) is formed having a linear shape. The shape becomes more curved as the grooves 14 are positioned closer towards the outer side. The groove 14 positioned at the center has the widest width and the shortest line length. The width becomes narrower and the line length becomes longer as the grooves 14 are positioned closer towards the outer side.

Specifically, long-side lengths of the rectangular waveguide tube ai and a line length Li are set such that a guide wavelength λgi (i=1 to 5) has a relationship shown in Expression 2 with the line length Li of each rectangular waveguide tube 11. The guide wavelength λgi is calculated in adherence to Expression 1 from a free space wavelength λ of a signal transmitted by the rectangular waveguide tube 11, and the long-side length ai of the rectangular waveguide tube (i=1 to 5, where long-side lengths a (a1, a2, a3, a4 and a5) respectively in FIG. 2B correspond to rectangular waveguide tubes 11*a*, 11*b*, 11*c*, 11*d* and 11*e* in FIG. 1B; the same applies hereafter).

[Expression 2]

$$Li=m\times\lambda gi \text{ (}m\text{ is a positive real number)} \quad (2)$$

In the high frequency device 1 configured in this way, the line length Li of the rectangular waveguide tube 11 is set to be m×λgi by the long-side length of the rectangular waveguide tube 11 becoming greater, when the line length becomes shorter.

In the high frequency device 1 configured in this way, as a result of the long-side length a (a1 to a5) of each rectangular waveguide tube 11 (11*a* to 11*e*) in the long-side direction (i.e., magnetic field-direction) being set accordingly, the line length L (L1 to L5) of each rectangular waveguide tube 11 can be arbitrarily set while maintaining a phase relationship between the high frequency signals transmitted from each rectangular waveguide tube 11. In particular, when the difference in line lengths between the rectangular waveguide tubes 11 is set to be shorter, the degree of freedom in arrangement of the rectangular waveguide tubes 11 can be improved while suppressing the degradation in propagation characteristics caused by temperature change.

Second Embodiment

Next, a second embodiment will be described.

According to the second embodiment, only the shapes of the through holes 12, the opposing areas 13, and the grooves 14 formed on the waveguide tube plate 10 differ from those according to the first embodiment. Therefore, differences in the configuration will mainly be described.

Figure 4:
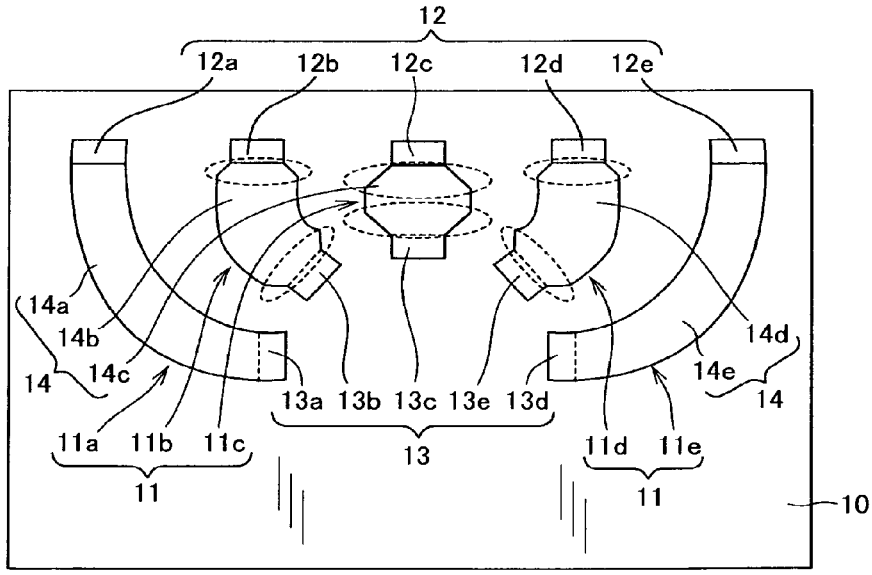
FIG. 4 is a planar view showing a waveguide tube plate according to a second embodiment of the present invention.

As shown in FIG. 4, the through holes 12 (12*a*, 12*b*, 12*c*, 12*d* and 12*e*) opposing the rectangular areas 22 and 32 of the first substrate 20 and the second substrate 30 in FIG. 1B, and the opposing areas 13 (13*a*, 13*b*, 13*c*, 13*d* and 13*e*) are all positioned on the outermost side. In other words, the through holes 12 and the opposing areas 13 are formed having a same size as the cross-section of the rectangular waveguide tubes 11*a* and 11*e* that have the shortest long-side length a.

In addition, the grooves 14*b*, 14*c* and 14*d*, excluding the grooves 14*a* and 14*e* forming the rectangular waveguide tubes 11*a* and 11*e*, are formed such that portions of the inner wall are tapered (see areas surrounded by dotted ellipses in FIG. 4), so that the long-side lengths a of the rectangular waveguide tubes 11*b*, 11*c*, 11*d* and 11*e* continuously change toward the through holes 12*b* to 12*d* and the opposing areas 13*b* to 13*d*.

Moreover, the length of each area formed having the tapered shape is set such as to be λg/3 or more, with the guide wavelength in each rectangular waveguide tube 11 as λg.

In the high frequency device 1 configured in this way, the transmission loss occurring as a result of the long-side length differing between both end sections (input and output terminals) of the rectangular waveguide tube 11 and other areas can be significantly reduced.

Figure 7:
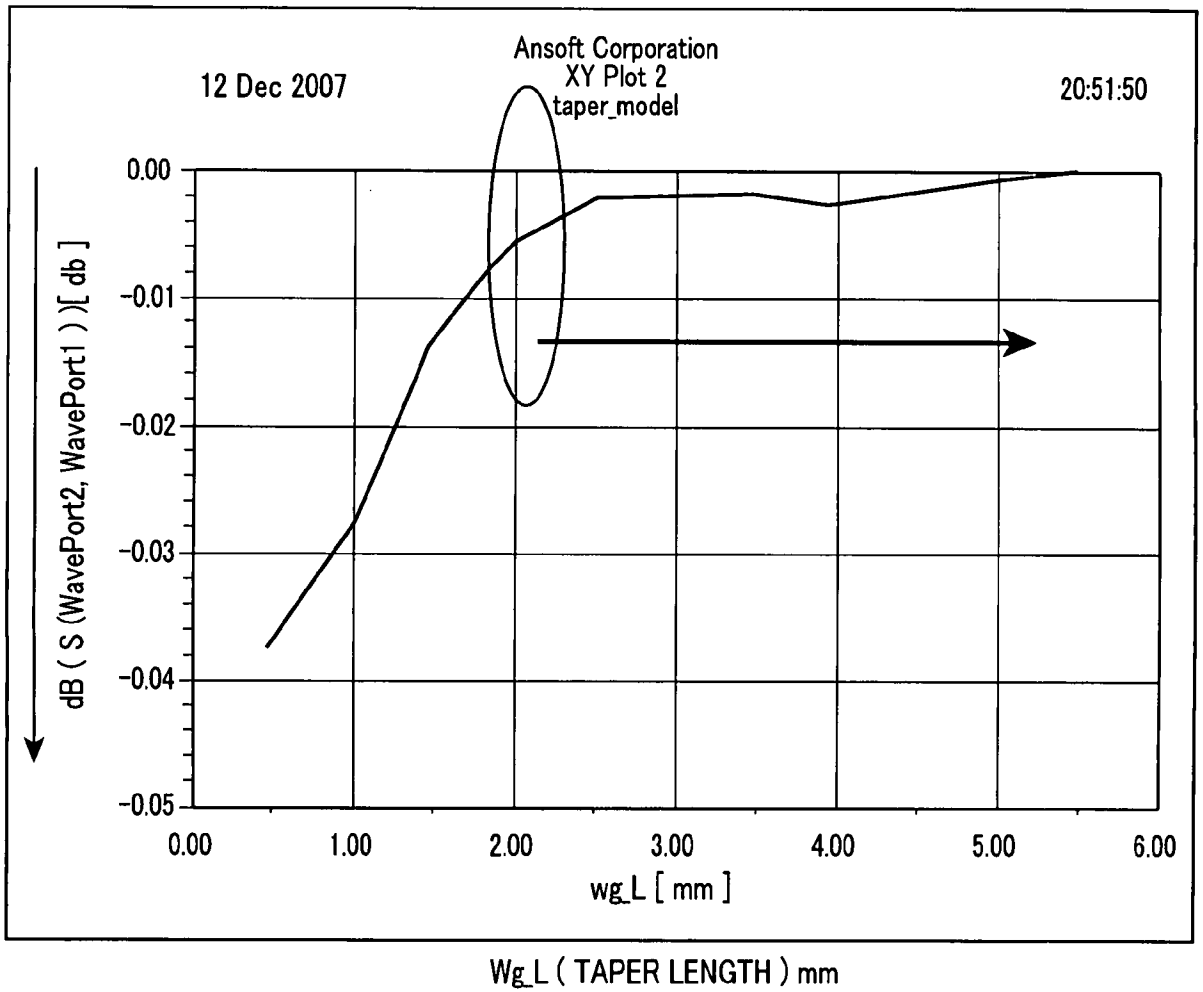
FIG. 7 is a graph of results showing a relationship between a length (taper length) of the inner wall formed having the tapered shape and passage loss determined by simulation.
Figure 8:
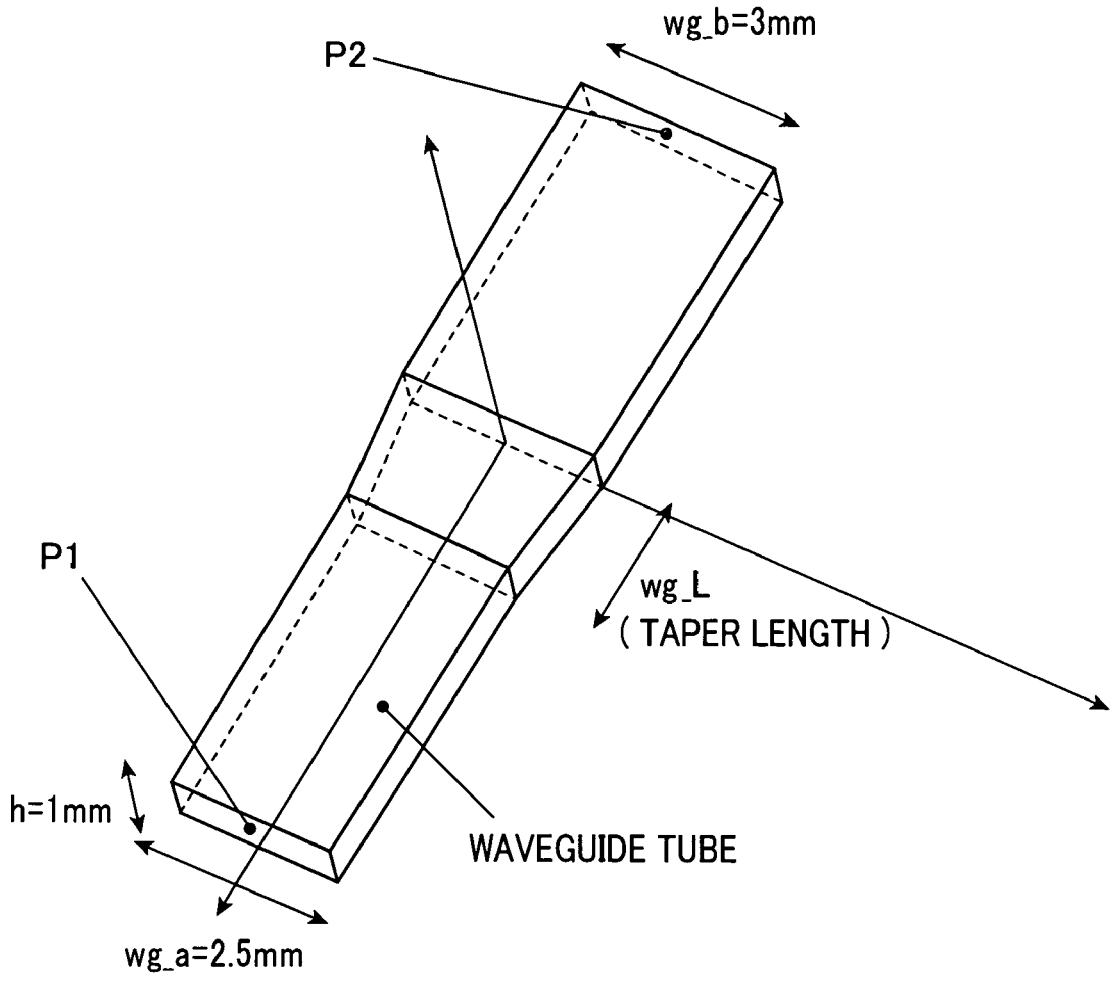
FIG. 8 is an explanatory diagram showing a rectangular waveguide tube model used in the simulation.

Here, FIG. 7 is a graph of results of a relationship between the length Wg_L in mm (taper length) of the inner wall formed having the tapered shape and passage loss in dB determined by simulation. FIG. 8 is an explanatory diagram of a rectangular waveguide tube model used in the simulation.

As shown in FIG. 8, the rectangular waveguide tube model transmits high frequency signals having a frequency of 76.5 GHz (free space wavelength λ=3.92 mm). A length of the short-side edge of the waveguide tube (P1 side in FIG. 8) is h=1 mm. A long-side length is Wg_b=3 mm (in other words, the guide wavelength λg=6.84 mm). A long-side length at the input and output terminals (P2 side in FIG. 8) of the rectangular waveguide tube is Wg_a=2.5 mm.

As shown in FIG. 7, the graph is that in which the taper length Wg_L is changed between a range of 0.5 mm (about 0.07 λg) to 6.0 mm (about 0.88 λg), and the passage loss from P1 to P2 is determined.

As is clear from FIG. 7, when the taper length Wg_L is λg/3 or more, the passage loss is sufficiently small (−0.005 dB or less).

Other Embodiments

According to the above-described embodiments, the rectangular waveguide tube 11 is formed by the grooves 14 being formed on the waveguide tube plate 10, and the grooves 14 being covered by the grounding pattern 25 formed on the first substrate 20. However, as in a high frequency device 3 shown in FIG. 5, the rectangular waveguide tube 11 can be configured through use of a waveguide plate 40 configured by through holes 41 being formed in place of the grooves 14 on a metallic plate having a same plate thickness as the short-side edge of the rectangular waveguide tube 11, and the openings of the through holes 41 being covered on both sides by the grounding patterns 25 and 35 formed on the first substrate 20 and the second substrate 30.

Figure 5:
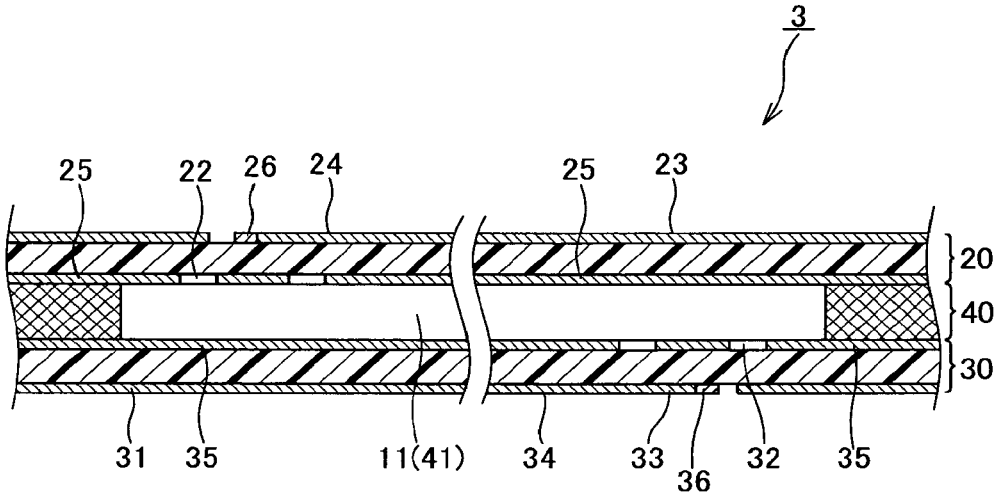
FIG. 5 is a cross-sectional view showing the vicinity of input and output terminals of a rectangular waveguide tube in the high frequency device according to an another embodiment of the present invention.

Moreover, as shown in FIG. 5, matching devices 26 and 36 formed by metallic patterns can be disposed near the center of the rectangular areas 22 and 32 of the first substrate 20 and the second substrate 30, respectively. As a result of such matching devices 26 and 36 being provided, reflection of electromagnetic waves can be controlled at the E bends formed in the rectangular areas 26 and 36, and transmission efficiency can be improved.

According to the above-described embodiments, the high frequency devices 1 and 3 are configured by the first substrate 20 and the second substrate 30 being attached to both surfaces of the waveguide tube plate 10. However, as in high frequency devices 5 and 7 shown in FIG. 6A and FIG. 6B, respectively, at least one of the first substrate 20 and the second substrate 30 can be attached to waveguide tube plates (substrate) 50 and 60 (FIG. 6B) made of metallic plates on which through holes 51 and 61 (FIG. 6B) are formed on areas equivalent to the rectangular areas 22 and 32.

Figure 6A:
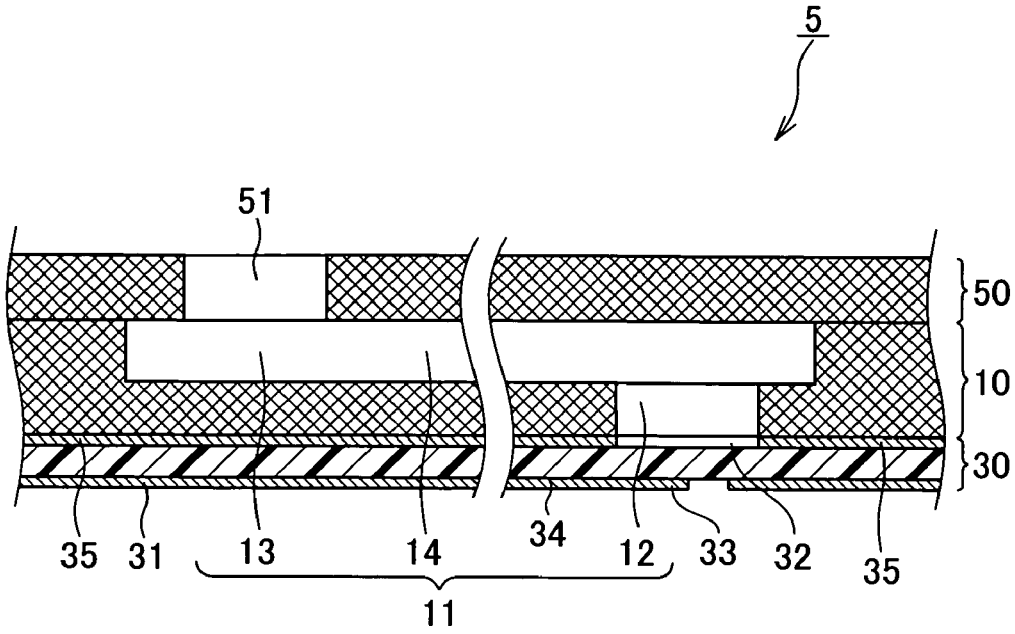
FIG. 6A and FIG. 6B are each a cross-sectional view showing the vicinity of input and output terminals of a rectangular waveguide tube in the high frequency device according to the another embodiment.
Figure 6B:
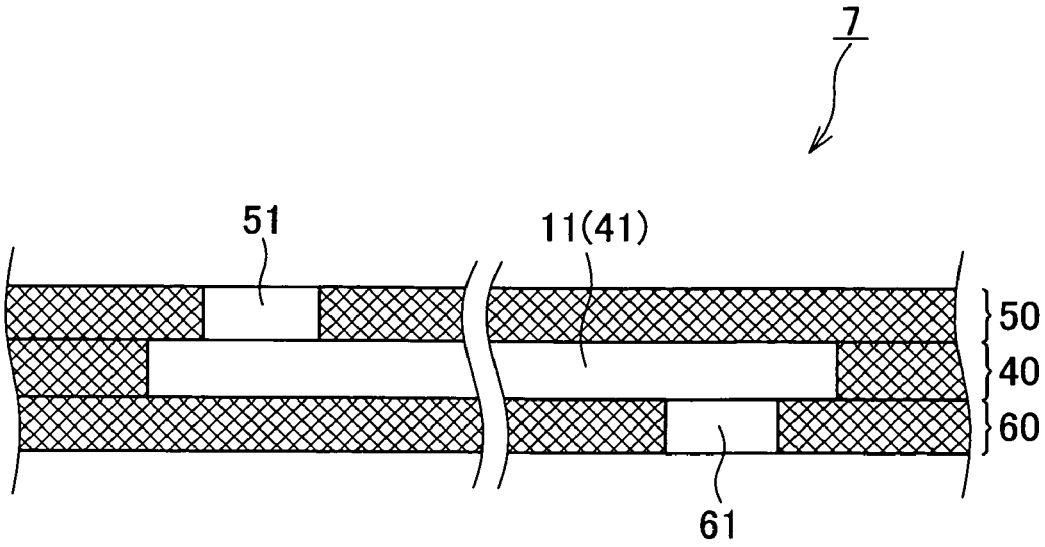

The high frequency device 5 in FIG. 6A is the high frequency device 1 according to the first embodiment, in which the waveguide tube plate 50 is attached instead of the first substrate 20. The high frequency device 7 in FIG. 6B is the high frequency device 3 in the other embodiment in which the waveguide tube plates 50 and 60 are attached instead of the first substrate 20 and the second substrate 30.

According to the above-described embodiments, a single layer resin-made substrate is used as the first substrate 20 and the second substrate 30. However, a multi-layer resin-made substrate can also be used.

What is claimed is:

1. A high frequency device comprising:

a plurality of rectangular waveguide tubes that transmit high frequency signals and have different line lengths in a longitudinal direction thereof, in which the high frequency signals are transmitted such that a phase relationship between the high frequency signals at input terminals of the plurality of rectangular waveguide tubes is maintained even at output terminals of the plurality of rectangular waveguide tubes, the high frequency device, wherein:

each of the rectangular waveguide tubes has a waveguide passage, the waveguide passages corresponding to the rectangular waveguide tubes are formed separately on an identical plane, each of the rectangular waveguide tubes has a rectangular section cut perpendicularly to the longitudinal direction of the waveguide tube, the rectangular section consisting of a long-side edge and a short side edge, a length of the long-side edge and a length of the short-side edge being defined as a long-side length and a short-side length, respectively, each of the long-side lengths of the plurality of rectangular waveguide tubes is set based on a line length of each rectangular waveguide tube such that the long-side length is set to be longer when the line length becomes shorter so as to allow a guide wavelength of the high frequency signal in the waveguide tube to be shorter.

2. The high frequency device according to claim 1, wherein:

the long-side lengths at the input terminals and the output terminals of the plurality of rectangular waveguide tubes are all formed having the same length; and the plurality of rectangular waveguide tubes include at least one waveguide tube having a portion of an inner wall where the long-side length of the inner wall differs between the input terminal and the output terminal, and other sections, the inner wall of the waveguide at least one tube having a tapered shape such that the long-side length continuously changes towards the input terminal and the output terminal.

3. The high frequency device according to claim 2, wherein:

the portion of the inner wall having the tapered shape has a length in the longitudinal direction of the waveguide tube, equal to $\lambda g/3$ or more, where $\lambda g$ refers to a guide wavelength of the rectangular waveguide tube.

4. The high frequency device according to claim 3, further each of the plurality of rectangular waveguide tubes comprising:

a metallic plate on which grooves are formed, the grooves having a depth equal to the short-side length and a width equivalent to the long-side length; and a substrate attached to a surface of the metallic plate on which the grooves are formed, having a grounding pattern in a position covering the grooves, excluding sections of a joint surface with the metallic plate in which the input terminals and the output terminals of the rectangular waveguide tubes are formed.

5. The high frequency device according to claim 3, each of the plurality of rectangular waveguide tubes comprising:

a metallic plate on which through holes are formed, having a plate thickness equivalent to the short-side length and a width equivalent to the long-side length; and a pair of substrates respectively attached to both surfaces of the metallic plate, having grounding patterns that cover the through holes, excluding sections of joint surfaces with the metallic plate in which the input terminals and the output terminals of the rectangular waveguide tubes are formed.

6. The high frequency device according to claim 2, each of the plurality of rectangular waveguide tubes comprising:

a metallic plate on which grooves are formed, the grooves having a depth equal to the short-side length and a width equivalent to the long-side length; and a substrate attached to a surface of the metallic plate on which the grooves are formed, having a grounding pattern in a position covering the grooves, excluding sections of a joint surface with the metallic plate in which the input terminals and the output terminals of the rectangular waveguide tubes are formed.

7. The high frequency device according to claim 2, each of the plurality of rectangular waveguide tubes comprising:

a metallic plate on which through holes are formed, having a plate thickness equivalent to the short-side length and a width equivalent to the long-side length; and a pair of substrates respectively attached to both surfaces of the metallic plate, having grounding patterns that cover the through holes, excluding sections of joint surfaces with the metallic plate in which the input terminals and the output terminals of the rectangular waveguide tubes are formed.

8. The high frequency device according to claim 1, each of the plurality of rectangular waveguide tubes comprising:

a metallic plate on which through holes are formed, having a plate thickness equivalent to the short-side length and a width equivalent to the long-side length; and a pair of substrates respectively attached to both surfaces of the metallic plate, having grounding patterns that cover the through holes, excluding sections of joint surfaces with the metallic plate in which the input terminals and the output terminals of the rectangular waveguide tubes are formed.

9. The high frequency device according to claim 8, wherein:

the substrate is made of a metallic plate on which through holes are formed in sections in which the input terminals and the output terminals are formed.

10. The high frequency device according to claim 8, wherein:

the substrate is made of a single-layer or a multi-layer resin-made substrate on which the ground pattern is printed.

11. The high frequency device according to claim 1, each of the plurality of rectangular waveguide tubes comprising:

a metallic plate on which grooves are formed, the grooves having a depth equal to the short-side length and width equivalent to the long-side length; and a substrate attached to a surface of the metallic plate on which the grooves are formed, having a grounding pattern in a position covering the overall grooves, excluding sections of a joint surface with the metallic plate in which the input terminals and output terminals of the rectangular waveguide tubes are formed.

12. The high frequency device according to claim 11, wherein:

the substrate is made of a single-layer or a multi-layer resin-made substrate on which the ground pattern is printed.

13. The high frequency device according to claim 12, wherein:

the substrate has no-formation areas in which the ground pattern is not formed in sections in which the input terminals and the output terminals are formed, and matching devices that are metallic patterns are disposed in the no-formation areas.

14. The high frequency device according to claim 11, wherein:

the substrate is made of a metallic plate on which through holes are formed in sections in which the input terminals and the output terminals are formed.

* * * * *